US007086331B2

(12) United States Patent
Moody

(10) Patent No.: US 7,086,331 B2
(45) Date of Patent: Aug. 8, 2006

(54) HAND-HELD INK STAMPER WITH SPARE INK SUPPLY

(75) Inventor: Brett Moody, Corona Del Mar, CA (US)

(73) Assignee: Cosco Industries, Inc., Corona Del Mar, CA (US)

( * ) Notice: Subject to any disclaimer, the term of this patent is extended or adjusted under 35 U.S.C. 154(b) by 0 days.

(21) Appl. No.: 11/030,531

(22) Filed: Jan. 4, 2005

(65) Prior Publication Data

US 2006/0144267 A1 Jul. 6, 2006

(51) Int. Cl.
*B41K 1/42* (2006.01)
*B41K 1/54* (2006.01)

(52) U.S. Cl. ..... 101/334; 101/327; 101/405

(58) Field of Classification Search ..... 101/327, 101/333, 334, 103, 104, 405, 406; B41K 1/54, B41K 1/38, 1/42, 1/46, 1/56
See application file for complete search history.

(56) References Cited

U.S. PATENT DOCUMENTS

| | | | | |
|---|---|---|---|---|
| 454,499 | A * | 6/1891 | Ryer | 101/334 |
| 1,369,512 | A * | 2/1921 | Winne | 101/381 |
| 5,649,485 | A * | 7/1997 | Dour et al. | 101/334 |
| 2005/0145127 | A1 * | 7/2005 | Zindl et al. | 101/333 |

FOREIGN PATENT DOCUMENTS

| | | | |
|---|---|---|---|
| JP | 09-109413 | * | 4/1997 |
| WO | WO 2005/084953 A2 | * | 9/2005 |

* cited by examiner

*Primary Examiner*—Leslie J. Evanisko
(74) *Attorney, Agent, or Firm*—DLA Piper Rudnick Gray Cary US LLP

(57) ABSTRACT

A hand-held ink stamper has a base, an actuator slidably disposed on the base, and a die mount movably mounted within the base. The die mount is connected to the actuator and movable to at least a printing position upon movement of the actuator. A die is mounted on the die mount. A first, removable ink supply is mounted within the base at a first position and provides ink to the die. At least one second, spare, removable ink supply is stored within the base at a second position. The second ink supply is removable for replacing the first ink supply by moving the second ink supply to the first position.

16 Claims, 8 Drawing Sheets

HAND-HELD INK STAMPER WITH SPARE INK SUPPLY

TECHNICAL FIELD OF THE INVENTION

The invention relates generally to hand-held ink stampers, and more particularly to ink stampers that hold an extra ink pad on the stamper.

BACKGROUND OF THE INVENTION

Conventional hand-held, self-inking ink stampers, like that disclosed in U.S. Pat. No. 5,649,485 issued to Door et al., have a rotating pintel that holds a die plate with a word or design to be printed. By actuating the stamper, the pintel can be swiveled between an inking position, where the pintel faces the interior of the stamper, and a printing position, where the pintel faces the exterior of the stamper. In the inking position, the die plate faces an ink pad positioned in an everted, removable tray that slides in and out of the side of the stamper for replacement.

Since a replacement ink pad is stored separately from the stamper, the ink pads can be lost, may require interruption of work to obtain or may use storage space that could be used for other things.

Thus, it is an object of the present invention to provide a hand-held ink stamper that holds at least one spare ink supply, such as an ink pad as one example.

It is another object of the present invention to provide a spare ink supply on a hand-held ink stamper where the ink supply does not interfere with the operation of the stamper.

These and other objects and advantages will be apparent from the following specification.

SUMMARY OF THE INVENTION

The problems mentioned above are solved by the present invention in which a spare ink supply, such as an ink pad, is conveniently located on the stamper itself for easy replacement of a used ink pad. More specifically, a hand-held ink stamper has a base, an actuator slidably disposed on the base, and a die mount movably mounted within the base. The die mount is connected to the actuator and movable to at least a printing position upon movement of the actuator. A die is mounted on the die mount. A first, removable ink supply is mounted within the base at a first position and provides ink to the die. At least one second, spare, removable ink supply is stored within the base at a second position. The second ink supply is removable for replacing the first ink supply by moving the second ink supply to the first position.

In one aspect of the invention, the die mount is a pintel rotatably mounted on the base between an inking position and the printing position. The first and second ink supplies are first and second ink pads respectively, and the pintel rotates the die to contact the first ink pad for the inking position.

In another aspect of the invention, the base has a frame defining spaces that receive upside-down trays that hold the ink pads for both use and storage of the ink pads.

In yet another aspect of the invention, the ink pads form a vertical array on the stamper.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
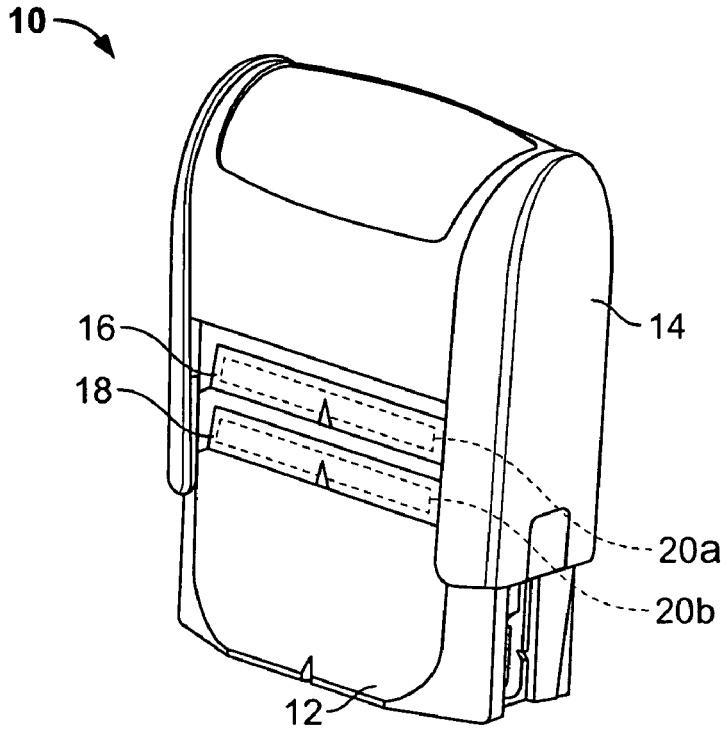
FIG. 1 is a front and right side perspective view of an ink stamper in accordance with the present invention.

Referring to FIG. 1, a hand-held, self-inking stamper 10 has a base 12 and an actuator 14 mounted on the base 12. The actuator 14 acts as a handle and slides up and down over the base 12 in order to operate the stamper. The base 12 has at least two removable drawers or trays 16 and 18 for respectively holding an ink supply such as ink containers or ink pads 20*a*, 20*b* as described in more detail below. The actuator 14 is shaped to slide over the trays 16 and 18 when operating the stamper.

Figure 2:
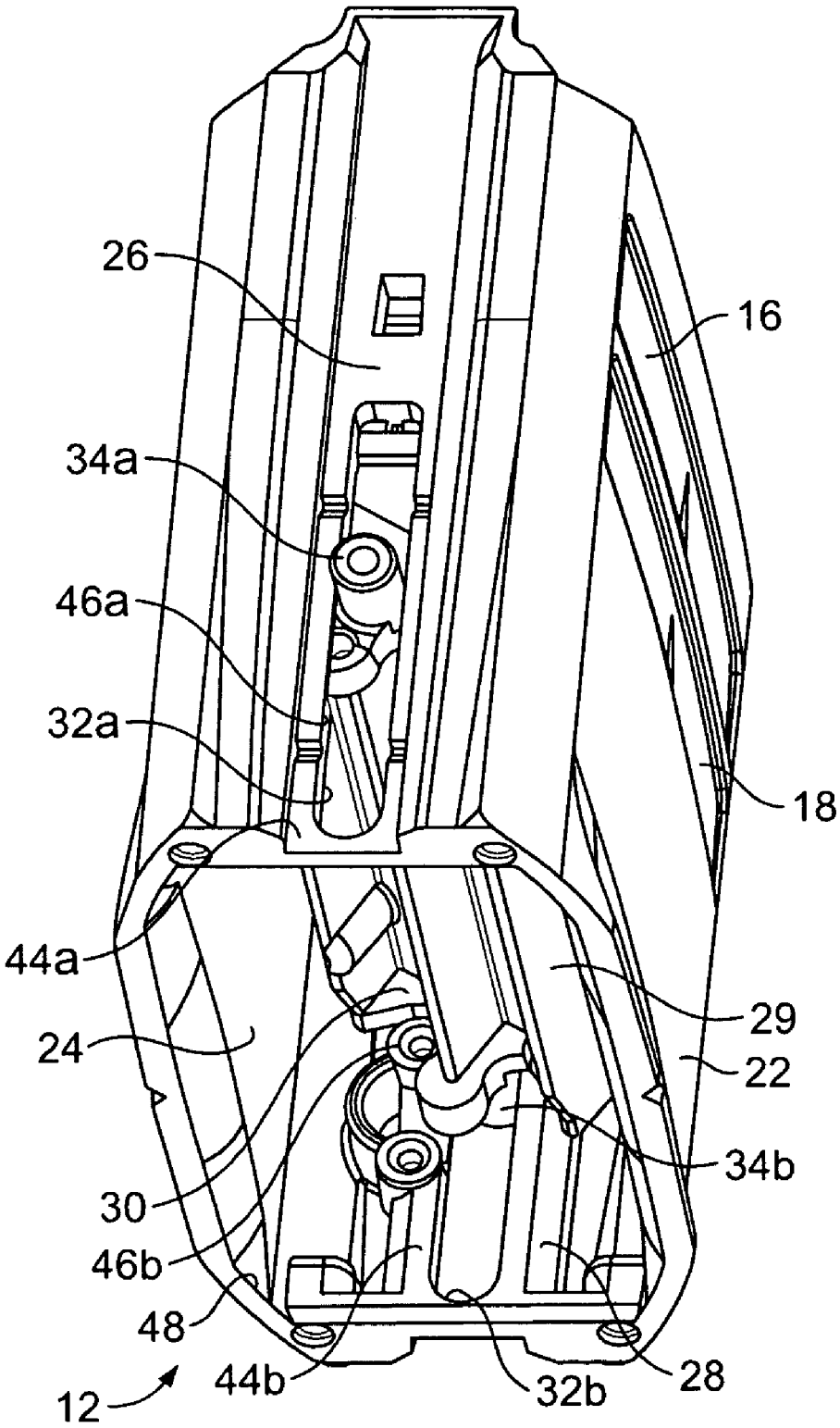
FIG. 2 is a bottom, left side perspective view of the ink stamper in accordance with the present invention.

As shown in FIG. 2, the base 12 has a front wall 22 opposing a symmetrical, back wall 24, and a left sidewall 26 opposing a symmetrical, right sidewall 28. Since ink stamper 10 is a self-inking stamper, it has a die mount 29 such as a rotating pintel 30 that is rotatably mounted to the base 12 through slots 32*a* and 32*b* respectively formed on sidewalls 26, 28. The pintel 30 has posts 34*a* and 34*b* extending through the slots and connecting to the actuator 14 on the exterior side of the sidewalls 26, 28.

Figure 3:
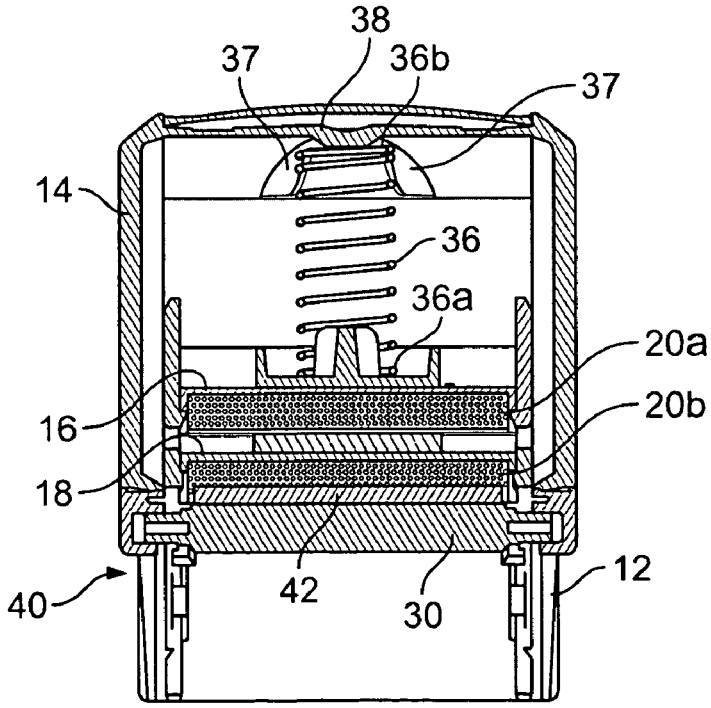
FIG. 3 is a cross-sectional view of the ink stamper in accordance with the present invention.

As shown in FIG. 3, a helical spring 36 is attached to the top of the base 12 at spring end 36*a* and an interior side of the top 38 of the actuator 14 at another spring end 36*b* in order to bias the actuator upward. The actuator 14 has fins 37 extending downward from actuator top 38 to hold the spring end 36*b* between the fins 37. The spring 36 biases the actuator 14 upward, and in turn, the pintel 30 into an "inking position" (generally indicated as 40 on FIG. 3) where the pintel faces upward toward the ink pad 20*b* held in the bottom-most tray 18. The pintel 30 has a die 42 mounted on, or integrally formed with, the pintel such that in the inking position, the die 42 is in contact with ink pad 20*b* so that the ink pad can supply ink to the die 42.

Since the pintel 30 is connected to the actuator 14, the pintel 30 slides downward along slots 32*a*, 32*b* as the actuator 14 is pushed downward in order to operate the stamper. As shown in FIG. 2, each sidewall 26 or 28 respectively has a rim 44*a* or 44*b* with protrusions 46*a*, 46*b* that abut the pintel 30 as it slides downward, forcing the pintel to rotate to a downward facing, "printing position" (not shown) where the die 42 faces downward and out the bottom 48 of the base 12.

Figure 4:
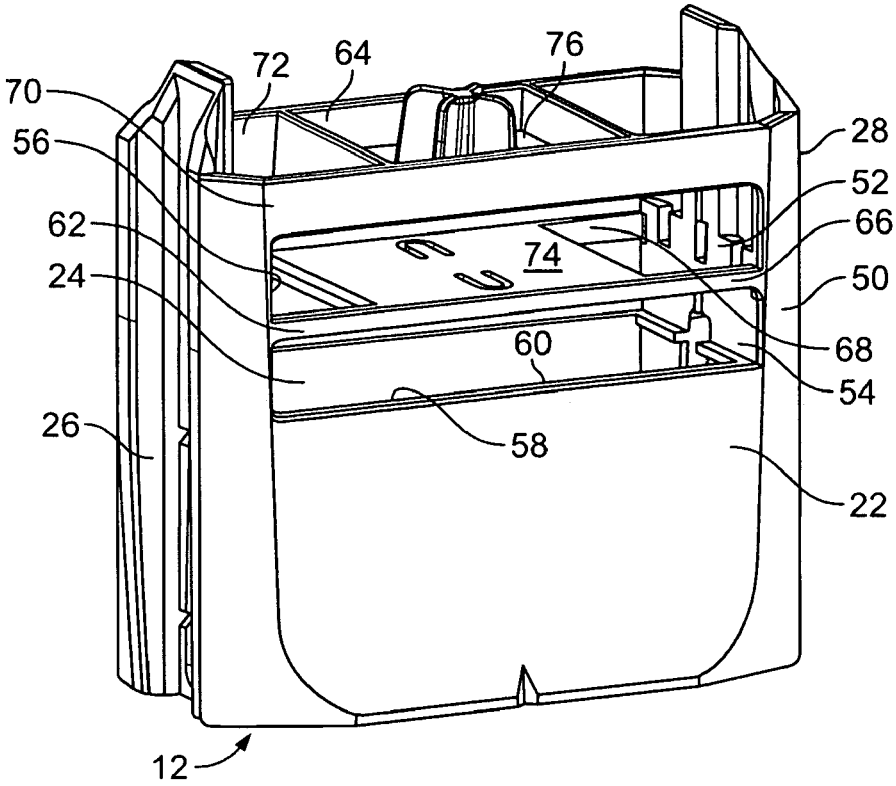
FIG. 4 is a front perspective view of a base of the ink stamper in accordance with the present invention.
Figure 5:
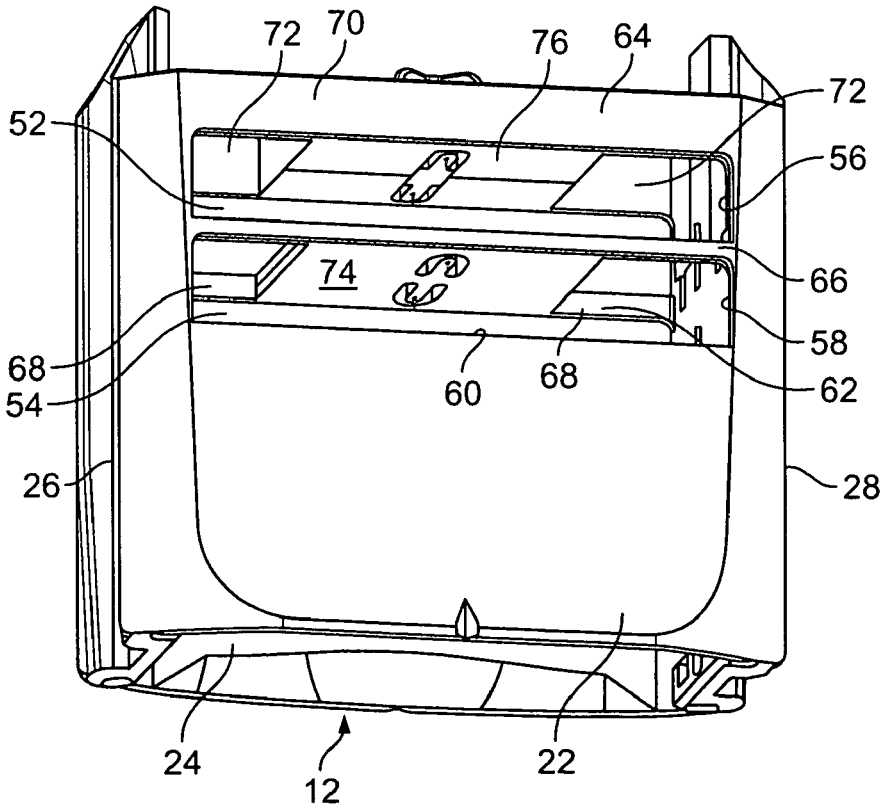
FIG. 5 is a front and bottom perspective view of the base of the ink stamper in accordance with the present invention.
Figure 6:
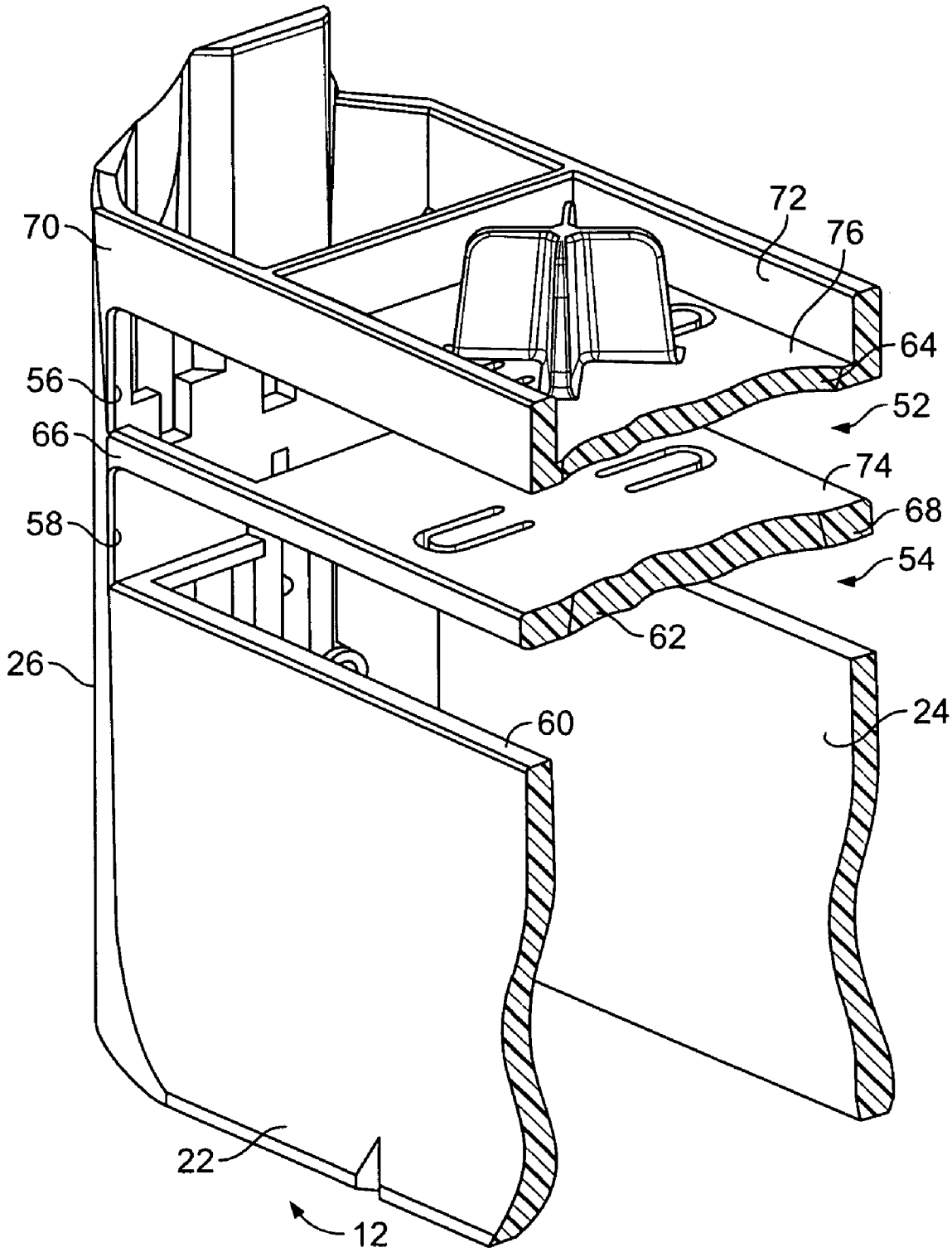
FIG. 6 is a partially cut-away, front and top perspective view of the ink stamper in accordance with the present invention.

Referring to FIGS. 4–6, the upper portion of the base 12 has a frame 50 defining spaces 52, 54 used to respectively hold trays 16, 18. The frame 50 includes a portion of the front wall 22 that defines slots 56, 58 which respectively provide the openings to spaces 52, 54. The back wall 24 is similar to the front wall 22.

The frame 50 also includes a lower rim 60 that supports the bottom-most tray 18, a central or dividing beam structure 62 that divides adjacent spaces 52, 54 while supporting the tray 16 above it, and an upper beam structure 64 above the top-most space 52. The beam structures 62 and 64 each respectively include two main beams 66, 68, and 70, 72 extending horizontally from one sidewall 26 to the other sidewall 28 of the base 12. A centrally located plate 74 or 76 respectively extends from a front wall beam 66 or 70 to the corresponding back wall beam 68 or 72, for each beam structure 62 or 64.

Figure 5A:
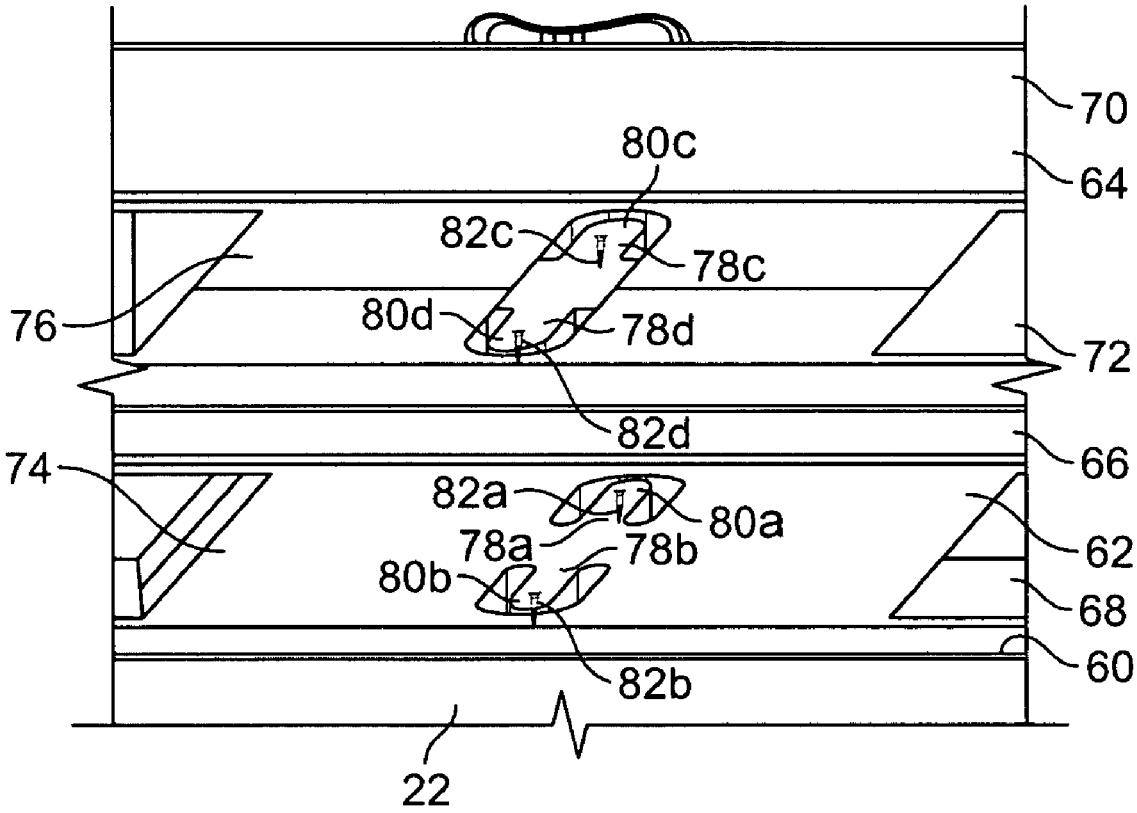
FIG. 5A is a close-up, bottom perspective view of a portion of the base of the ink stamper in accordance with the present invention.
Figure 7:
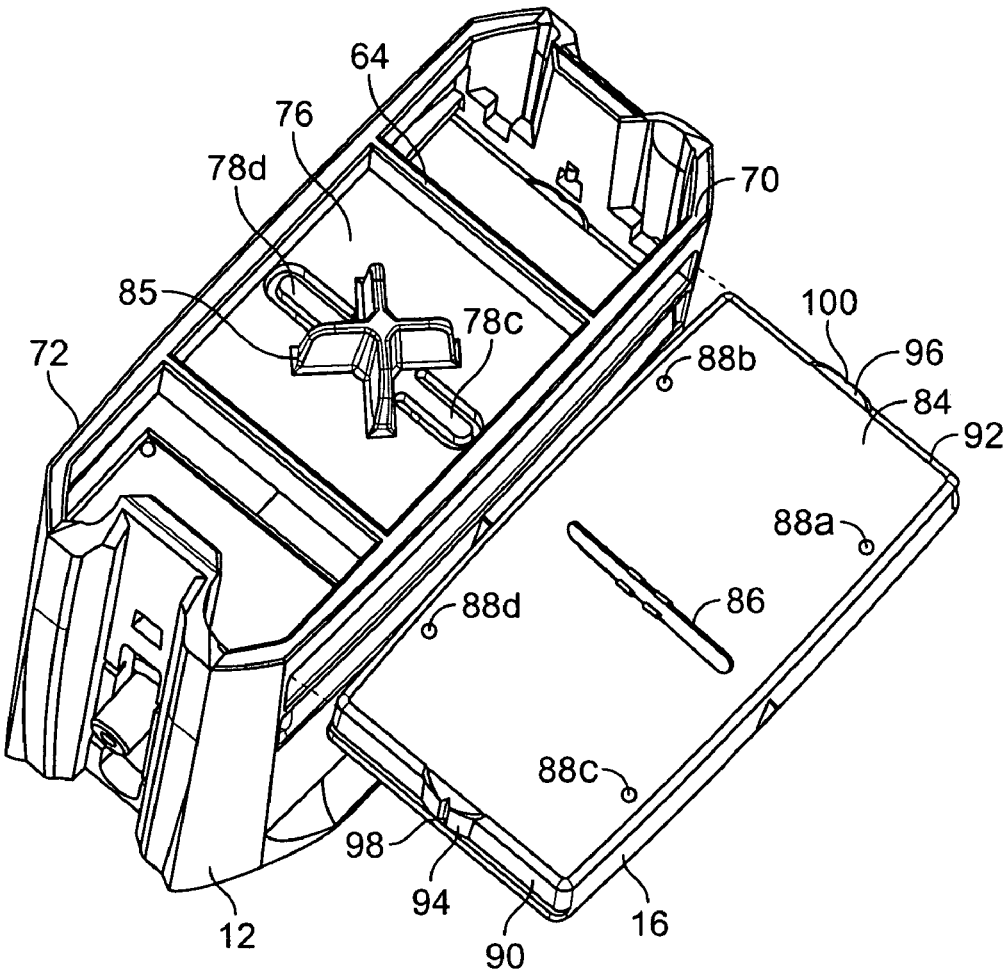
FIG. 7 is a bottom and front perspective view of an ink pad and tray used with the ink stamper in accordance with the present invention.
Figure 9:
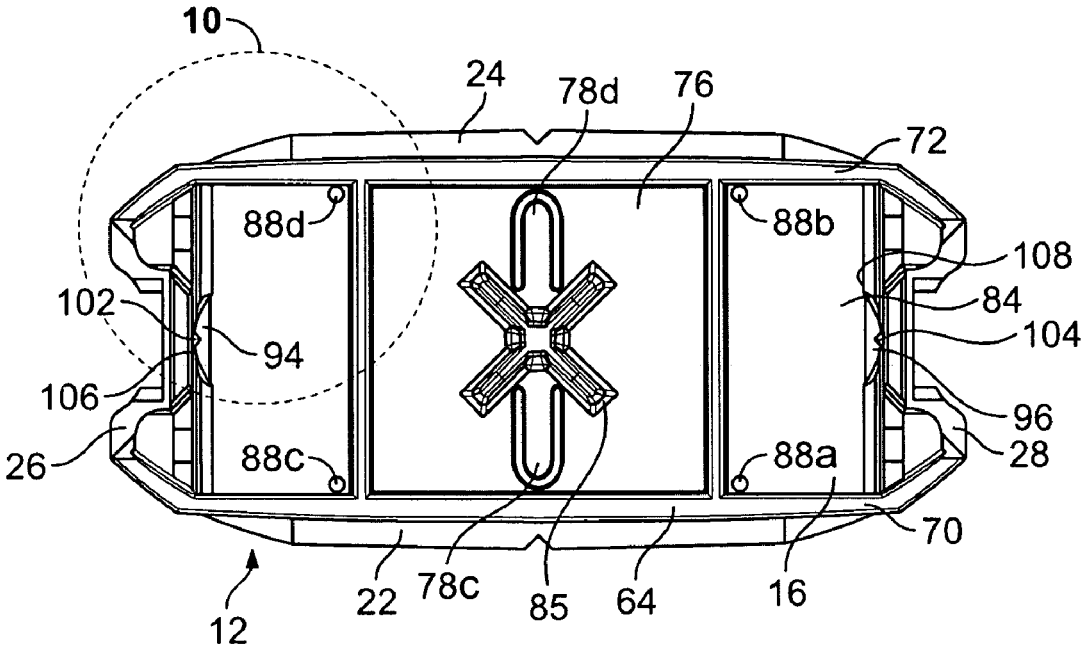
FIG. 9 is a top view of the base of the ink stamper in accordance with the present invention.

The plates 74 and 76 each have oppositely extending resilient tongues 78*a*–*d* as shown in FIG. 5A. Each tongue 78*a*–*d* has a free distal end 80*a*–*d* with a downwardly extending pin 82*a*–*d* for engaging a tray 16 or 18. As shown in FIG. 7, the top surface 84 of each tray 16 has an elongated, centering groove 86 running toward the front and back walls 22, 24 of the base for receiving the pins 78*a*–*d* (only one tray is shown but both trays 16 and 18 have the same structure). Alignment pins 88*a*–*d* also extend upward from the top surface 84 of the trays 16, 18 to align the trays 16 and 18 within slots 56, 58 and with beam structures 62 or 64 as shown in FIG. 9.

Also shown in FIG. 7, the plate 76 on the upper beam structure 64 has an X-shaped spring mount 85 extending upward to hold spring end 36*a*.

Figure 8:
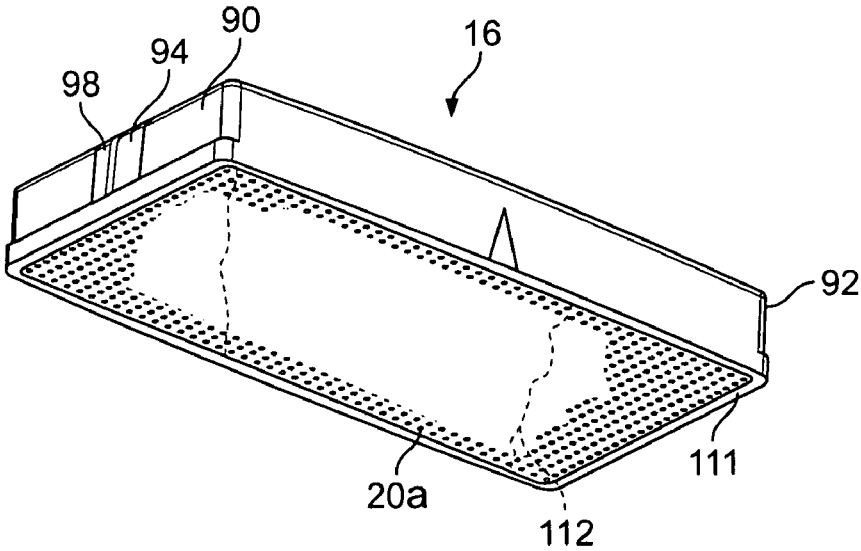
FIG. 8 is a top perspective view of the base and tray of the ink stamper in accordance with the present invention.
Figure 10:
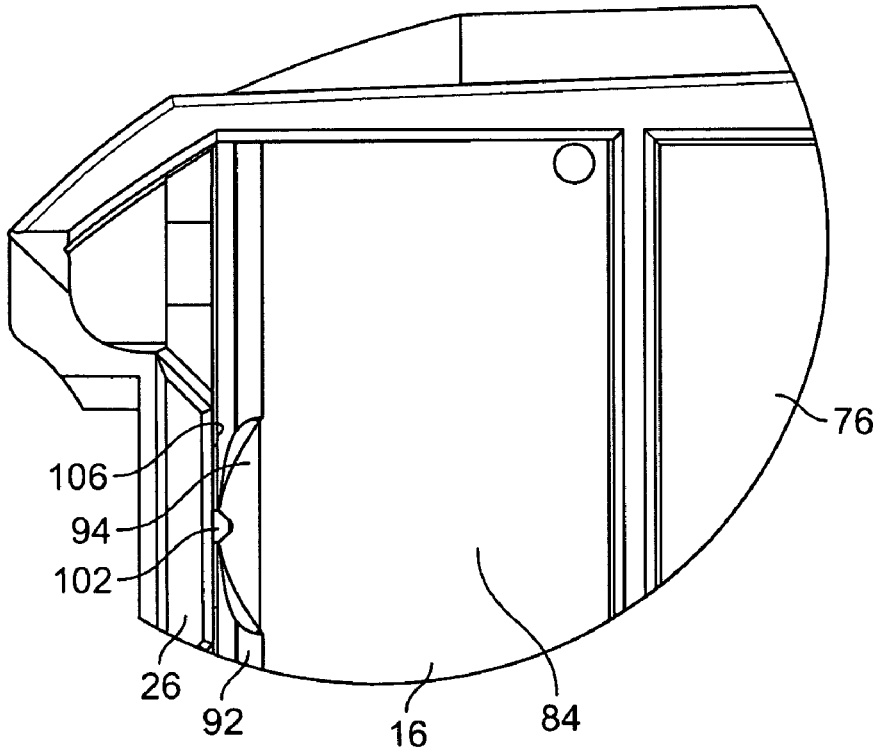
FIG. 10 is a close-up, top view of the ink stamper in accordance with the present invention.

As shown on FIGS. 7–8, the tray 16, and similarly tray 18, has a pair of far, opposing sidewalls 90, 92 with a convex protrusion 94 or 96 that defines a vertically extending locking groove 98 or 100. As shown on FIGS. 9–10, vertically extending ribs 102, 104 respectively protrude from an interior surface 106, 108 on sidewalls 26, 28 of the base 12. The ribs 102, 104 correspond and engage the locking grooves 98, 100 when the trays are placed in the spaces 52, 54. The ribs 102, 104 and the pins 78*a*–*d* both prevent the trays from easily sliding out of the base 12 without a user applying an external force to the trays.

In operation, once a first ink pad 20*b*, positioned at the "inking space" 54, runs out of ink, the user removes tray 18 and ink pad 20*b* from inking space 54. The user then removes the second, spare tray 16 and ink pad 20*a* from the storage space 52 and places the spare tray 16 and ink pad 20*a* into the inking space 54. The user may then place a new, spare tray and ink pad in the empty storage space 52.

The second, spare tray 16 is held upside-down as shown in FIG. 8 when placed on the base 12, just like the operating tray 18. Both ink pads 20*a*, 20*b* do not fall out of the trays 16 or 18 because they are dimensioned to have a tight fit within the tray. Alternatively, the ink pads 20*a*, 20*b* are simply attached by an adherent or fastener.

While the bottom 111 of the trays 16, 18 are not covered to entirely enclose the ink pads 20*a*, 20*b* within the trays, such a removable cover 112 (indicated in dash line on FIG. 8) could easily be provided with the trays. A cover 112 could be made of a thin paper or similar material that adheres to the trays 16, 18. The cover 112 could also be removed before the tray is placed on the base 12, or the frame 50 could be dimensioned to receive the trays with the cover 112. Cover 112 could also be removable from tray 16 or 18 by pulling on an exposed edge of the cover while the tray 16 is in the stamper.

It will also be appreciated that while the tray 16 or 18 is shown to completely separate from the stamper 10, trays 16, 18 may actually be only partially removable, like a drawer, with any form of stopper (not shown) used to prevent separation of the trays from the base 12. In this design, a user simply places a removable ink pad or other form of contained ink supply, in each of the trays 16, 18 rather than completely replacing the entire tray and ink pad.

Figure 11:
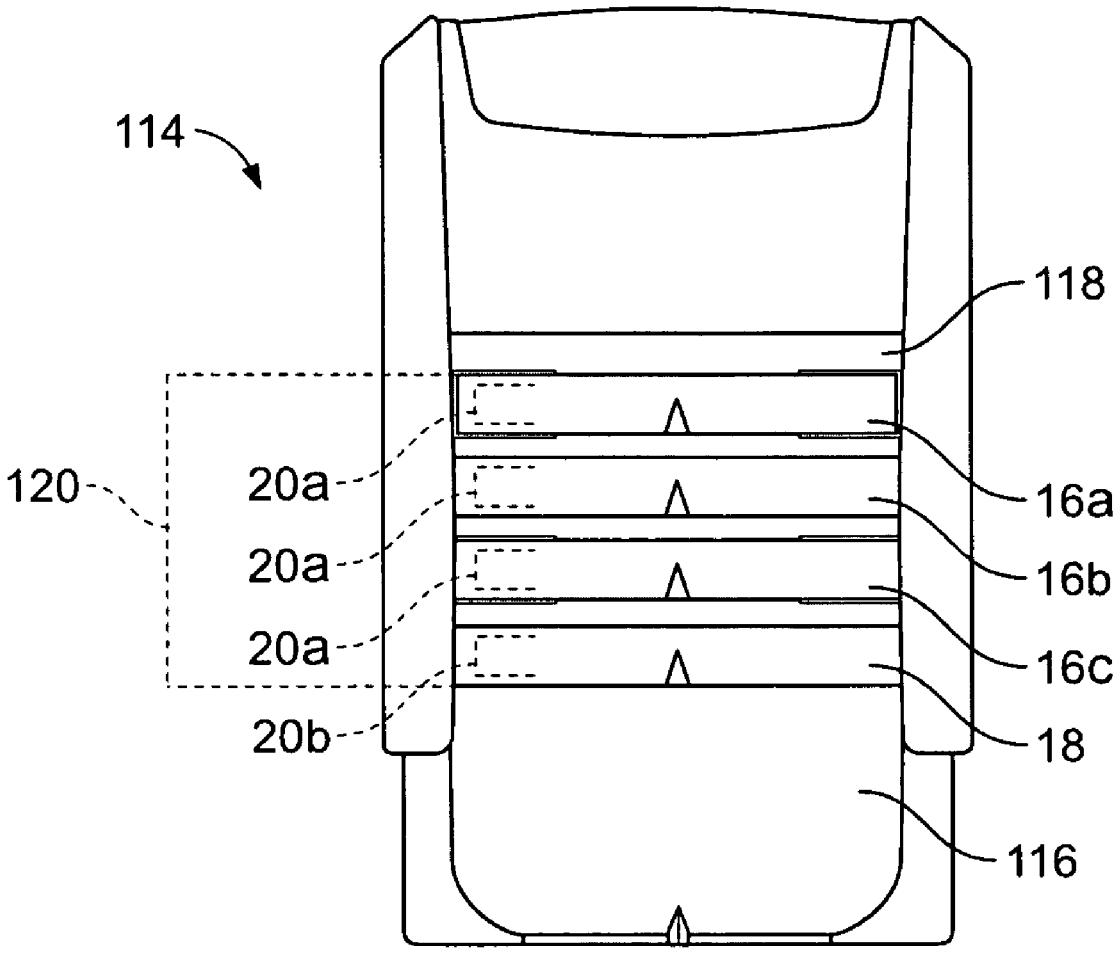
FIG. 11 is a front elevational view of an alternative ink stamper in accordance with the present invention.

Referring to FIG. 11, an ink stamper 114 has more than one spare ink pad and in fact has multiple trays 16*a*–*c* each holding an ink pad 20*a* (not shown). The stamper 114 has a base 116 and frame 118 similar to that of base 12 and frame 50. Thus, it will be understood that the present stamper 10 or 114 is not limited to any certain number of storage spaces and/or spare ink pads 20*a*. A vertical array 120 of storage ink pads 20*a*/20*b* and/or trays 16*a*–*d* can extend as high as desired.

It will also be appreciated that the present invention applies to pre-inking stampers as well as self-inking stampers or any other hand-held stamper as long as a removable, spare ink supply in any form including a cartridge, bag, drawer or tray is placed on a hand-held ink stamper.

While the preferred embodiments of the invention have been shown and described, it will be apparent to those skilled in the art that changes and modifications may be made therein without departing from the spirit of the invention, the scope of which is defined by the appended claims.

What is claimed is:

1. A hand-held ink stamper, comprising:

a base;

an actuator slidably disposed on said base;

a die mount movably mounted within said base, connected to said actuator, and movable to at least a printing position upon movement of said actuator;

a die mounted on said die mount;

a first tray and a second tray, each slidably mounted on said base;

a first, removable ink pad mounted within said first tray in said base at a first position, said first ink pad providing ink to said die; and a second, spare, removable ink pad stored within said second tray in said base at a second position, wherein said second ink pad and tray are removable for replacing said first ink pad and tray at said first position by moving said second ink pad and tray to the first position.

2. The stamper of claim 1, wherein said die mount is a pintel rotatably mounted on said base between an inking position and said printing position, said pintel rotating said die to contact said first ink pad for said inking position.

3. The stamper of claim 1, further comprising more than two of said second ink pads.

4. The stamper of claim 1, wherein said tray holding said second ink pad is upside-down when mounted on the stamper.

5. The stamper of claim 1, wherein said base has a frame defining at least two spaces for holding at least two said trays respectively at said first and second positions.

6. The stamper of claim 5, wherein said frame includes a front wall defining at least two slots, each slot communicating with one said space, said trays being received and removed through said slots.

7. The stamper of claim 5, wherein said frame includes means for preventing unintentional removal of said trays from said spaces.

8. The stamper of claim 7, wherein said means for preventing includes at least one said tray having a side surface with a groove, and wherein said frame includes at least one sidewall with an elongated rib disposed for removably engaging said groove.

9. The stamper of claim 5, wherein said frame includes at least one dividing beam structure disposed between adjacent said spaces.

10. The stamper of claim 9, wherein said frame of said base includes two opposing sidewalls, and wherein said dividing beam structure includes two horizontal beams running from one said sidewall to the other said sidewall, and a plate extending from one said beam to the other said beam, said actuator and said pintel being slidably attached to said sidewalls.

11. The stamper of claim 10, wherein said plate has at least one tongue with a distal end, and a pin extending from said distal end for engaging a top surface of said tray.

12. The stamper of claim 11, wherein said plate has two said tongues extending in different directions on said plate and both said tongues having at least one said pin.

13. The stamper of claim 9, wherein said frame has an uppermost beam structure above the uppermost said space, and the stamper further comprising a spring connected to said actuator and said base for biasing said actuator away from said base, and wherein said plate on said uppermost beam structure includes an extension, said spring being mounted on said extension.

14. A hand-held ink stamper, comprising:

a base having a frame defining inking and storage spaces adapted for removably holding ink pads including a first ink pad being held in the inking space and at least one second, spare ink pad being held in the storage space, one said storage space being provided for each said spare ink pad;

a plurality of trays slidably mounted one each in the spaces of said base, each said tray holding one said ink pad;

an actuator disposed on said base and in a sliding relation with said base;

a pintel rotatably mounted within said base and connected to said actuator for rotating between a printing position and an inking position upon movement of said actuator; and a die mounted on said pintel, said pintel placing said die in a position to receive ink from said ink pad at said inking space when said pintel is in said inking position, wherein said frame is adapted for permitting removal of said second ink pad and its tray from said storage space and for placement of said second ink pad and its tray in said inking space for replacing said first ink pad and its tray.

15. A hand-held ink stamper, comprising:

at least two ink pads including at least one first ink pad and at least one second, spare ink pad used for replacing said first ink pad;

a base having a frame defining an array of at least two spaces, said spaces including at least one inking space and at least one storage space, said first ink pad being removably held at said inking space and said second, spare ink pad(s) being removably held at said storage space(s), wherein one of said second ink pads is placed at said inking space for replacing said first ink pad;

a plurality of trays slidably mounted one each within the spaces of base, each said tray holding one of said ink pads; and a die disposed within said base and movably attached to said base, said die being in positioned in contact with said first ink pad at said inking space for providing ink to said die.

16. The stamper of claim 15, wherein said array of spaces forms a vertically stacked array of said ink pads on said stamper.

* * * * *